United States Patent [19]

Hufnagel

[11] Patent Number: 4,903,902

[45] Date of Patent: Feb. 27, 1990

[54] MACHINE FOR CRUSHING WOOD PALLETS

[76] Inventor: Paul L. Hufnagel, 3849 S. 99 East Ave., Tulsa, Okla. 74146

[21] Appl. No.: 350,579

[22] Filed: May 11, 1989

[51] Int. Cl.[4] ..... B02C 1/00

[52] U.S. Cl. ..... 241/84; 241/95; 241/100; 241/271

[58] Field of Search ..... 241/95, 100, 262, 270, 241/271, DIG. 38, 36, 79.1, 84

[56] References Cited

U.S. PATENT DOCUMENTS

| | | | |
|---|---|---|---|
| 817,298 | 4/1906 | Byers et al. | 241/270 X |
| 2,318,142 | 5/1943 | Cox et al. | 241/95 X |
| 3,105,643 | 10/1963 | Todd | 241/95 |
| 4,168,034 | 9/1979 | Leger | 241/79.1 |
| 4,253,615 | 3/1981 | Koenig | 241/36 |
| 4,694,996 | 9/1987 | Siegel | 241/270 X |

FOREIGN PATENT DOCUMENTS

| | | | |
|---|---|---|---|
| 1360658 | 11/1964 | France | 241/270 |
| 31485 | 11/1933 | Netherlands | 241/270 |

*Primary Examiner*—Mark Rosenbaum
*Attorney, Agent, or Firm*—Head & Johnson

[57] ABSTRACT

A machine for crushing wood pallets having a stationary table with a grid providing vertical passages therethrough, a ram mounting above the table and reciprocable towards and away from the table and having an array of downwardly extending cutters which, when the ram is fully advanced towards the table, extend partially through the table grid, hydraulic cylinder-pistons for alternatively reciprocating the ram towards and away from the table, a conveyor for moving wood pallets onto the table and a collector below the table for collecting broken pieces of crushed wood pallets passing through the table grid.

8 Claims, 5 Drawing Sheets

MACHINE FOR CRUSHING WOOD PALLETS

SUMMARY OF THE INVENTION

Much of the manufactured products and produce moved in commerce in the United States and in most other industrialized nations of the world are stored and transported on wood pallets. These wood pallets are typically formed of vertical runners having boards nailed to the tops and bottoms of the runners. Wood pallets are a good, practical means of storing and transporting goods since they can be easily moved by forklift trucks and are relatively inexpensive to construct.

Wood pallets, however, have a limited life expediency. The high stress to which pallets are subjected when heavy loads are stored on them and damage which occur in handling of the pallets when they are being stored awaiting reuse causes the boards to split and crack and become unnailed. In addition, wood has a long life under ideal temperature and humidity conditions, but in many instances, wood pallets are used to store products in damp areas where the wood deteriorates from rotting. In any event, for various reasons, each day a large number of wood pallets become defective and unusable. Disposing of such wood pallets has become a serious ecological problem. Because of their relatively large bulk, many sanitary landfills and other trash disposable locations have enacted regulations prohibiting the disposal of wood pallets. While wood pallets are subject to being repaired, that is, by removing defective runners or boards, nevertheless, many wood pallets reach the point where repair is not economically feasible. For this reason, a serious problem has developed in the industrialized worlds with respect to disposing of wood pallets.

Various saw-type arrangements have been devised for cutting wood pallets into small pieces so that they can be efficiently and economically disposed of, but wood pallets are almost universally assembled by the use of nails. The fact that the wood pallets include nails discourages the use of saws, and, in general, has made sawing of scrap wood pallets into acceptable pieces non-economical.

The present invention is directed to an apparatus for crushing wood pallets into small pieces so that their bulk is substantial. The small wood pieces are more acceptable by sanitary landfills and other trash disposal facilities.

The machine of the present invention for crushing wood pallets is formed of a stationary table having a grid providing vertical passages through it. Extending upwardly from the vertical table are guide rails, and reciprocally mounted on the guide rails is a ram. While the positional arrangement of a machine for practicing the invention may vary, in a typical embodiment a stationary table is generally horizontal, and the ram is vertically reciprocated above the table. The ram has an array of downwardly extending cutters, preferably formed of vertical metal plates. The cutters on the ram are in patterns which mate with corresponding patterns formed in the table grid. When the ram is fully downwardly advanced, the ram cutters extend at least partially through the table grid. In the same manner that the ram cutters are preferably formed of vertical metal plates, the ram grid is formed of vertical metal plates, and the grid pattern and the ram cutter pattern are complimentary to each other. The spacing between the elements forming the table grid pattern defines the maximum size of the pieces which will normally pass through the grid during operation of the machine.

A conveyor is provided for moving wood pallets onto the horizontal table. A stop plate is affixed to the table. When a pallet is moved by the conveyor onto the table, the limit of movement is established by the stop table to position a portion of the pallet over the table grid.

Hydraulic cylinder-pistons reciprocate the ram. When the ram is in the upward position the conveyor moves a portion of a pallet onto the table and hydraulic pressure is applied to the cylinder-pistons to force the ram downwardly, the ram cutters engaging the portion of the pallet extending over the table and forcing broken pieces of the pallet through the table grid system.

Below the table, a hopper is positioned to collect the broken pieces of the crushed wood pallet, and from the hopper, another conveyor can be used to convey the broken pieces for disposal.

The invention will be better understood with reference to the following description and claims taken in conjunction with the attached drawings.

DESCRIPTION OF THE PREFERRED EMBODIMENT

Figure 1:
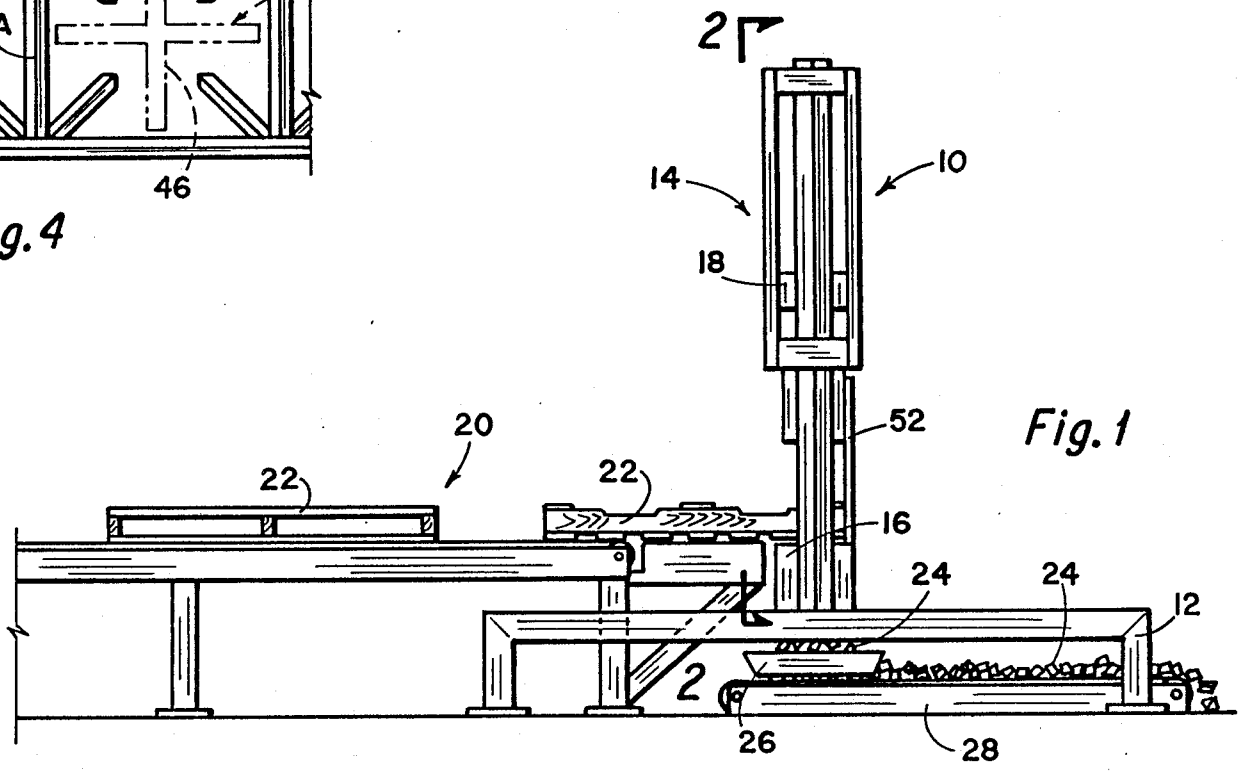
FIG. 1 is an elevational side view of a machine for crushing wood pallets incorporating the principles of this invention.

Referring to the drawings and first to FIG. 1, a machine for crushing wood pallets is indicated by the numeral 10. The machine includes a superstructure 12 which supports a crusher mechanism generally indicated by the numeral 14 and which will be described in detail subsequently. Generally, the crusher mechanism 14 includes a stationary table 16 and a ram 18. Wood pallets are broken into small pieces by the interaction between the ram 18 and stationary table 16.

Supported adjacent the superstructure 12 is a conveyor 20 by which wood pallets 22 are moved towards the crusher mechanism 14 wherein the wood pallets are crushed into small pieces 24. The small pieces pass downwardly through the stationary table 16 into a hopper 26. From the hopper, the small pieces 24 may be moved away from the machine for disposal by means of a conveyor 28.

Figure 4:
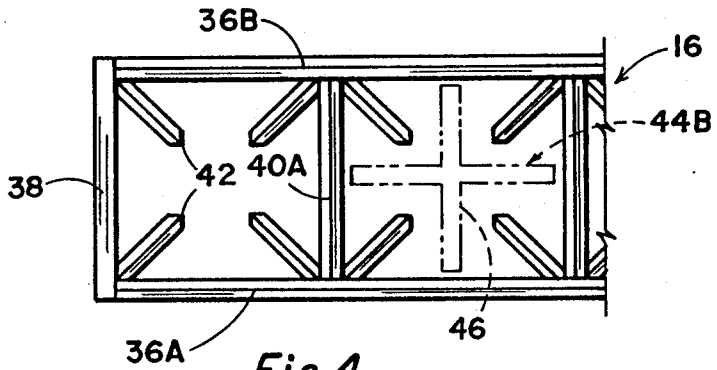
FIG. 4 is a partial horizontal cross-sectional view taken along the line 4—4 of FIG. 2 and showing the grid arrangement of the embodiment of FIGS. 1 and 2.
Figure 8:
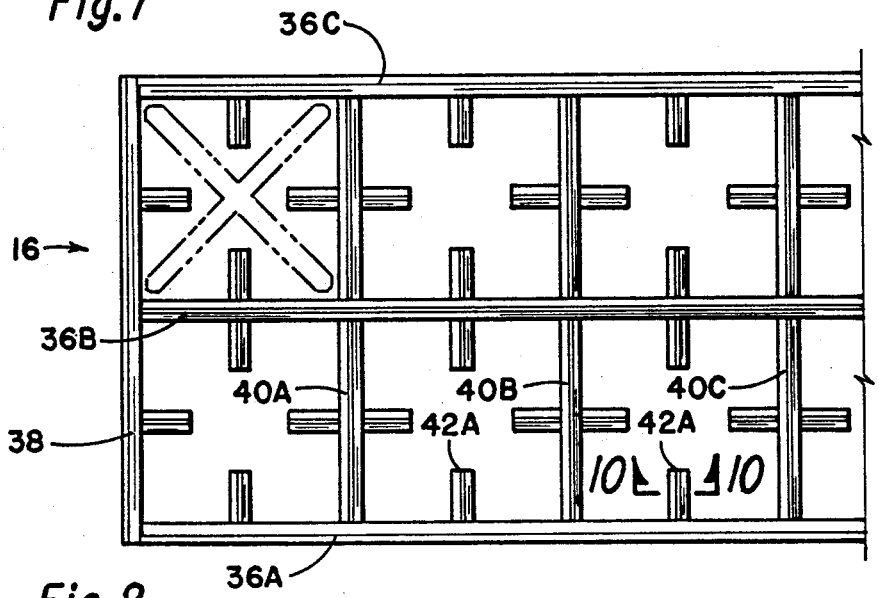
FIG. 8 is a partial horizontal view taken along the line of 8—8 of FIG. 6, looking downwardly (with the wood pallet not being shown) onto a portion of the table grid.

Referring to FIGS. 2–5, the crusher mechanism 14 will be described. Extending upwardly from the stationary table 16, and more particularly from each end of the table, are an opposed pair of vertical parallelled runners 30A and 30B. The runners are illustrated as being in the form of square cross-sectional tubing. By means of rollers 32, the ram 18 is movable vertically towards and away from the stationary table 16. To reciprocably position ram 18, a pair of cylinder-pistons 34A and 34B is employed. By controlled application of hydraulic pressure to the cylinder-pistons 34A and 34B, the ram 18 is sequentially raised and lowered with respect to the stationary table 16. As shown in FIGS. 4 and 8, the stationary table 16 is formed by a plurality of lengthwise vertical plates 36A, 36B and 36C. Positioned at each end of the stationary table is a plate 38, only one end being shown, and spaced and parallelled to the end plate 38 are vertical divider plates 40, only the plates 40A and 40B being shown. The upper edges of plates 36, 38 and 40 are tapered to form a cutting edge, although it is not necessary that the cutting edge be particularly sharp. Formed at the juncture of the end plates 38 and divider plates 40 with the lengthwise vertical plates 36 are secondary plates 42, there being four secondary plates in each rectangular area formed by the divider plates and lengthwise vertical plates. The secondary plates 42 are utilized to provide a horizontal pattern and more particularly, an array of horizontal patterns forming the grid of table 16. The secondary plates 42 are employed to provide a pattern which is complimentary to the pattern of the cutter plates of ram 18.

Figure 2:
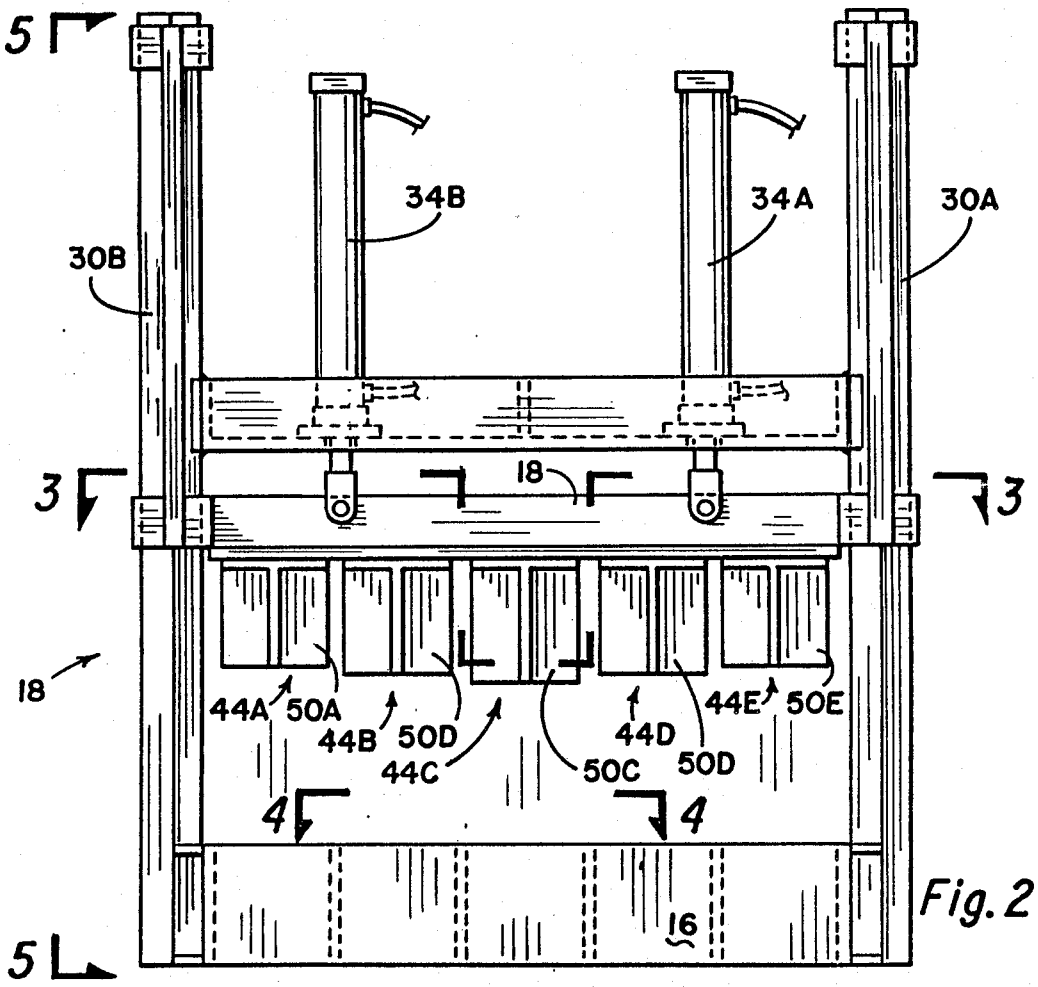
FIG. 2 is a partial elevational view of the main crusher mechanism as employed in the machine of FIG. 1.
Figure 5:
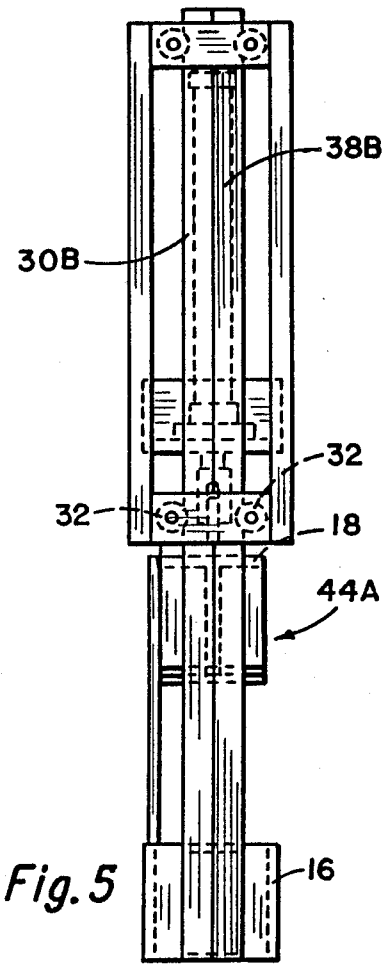
FIG. 5 is an end view of the basic crusher mechanism as employed in the machine, as taken along line 5—5 of FIG. 2.
Figure 3:
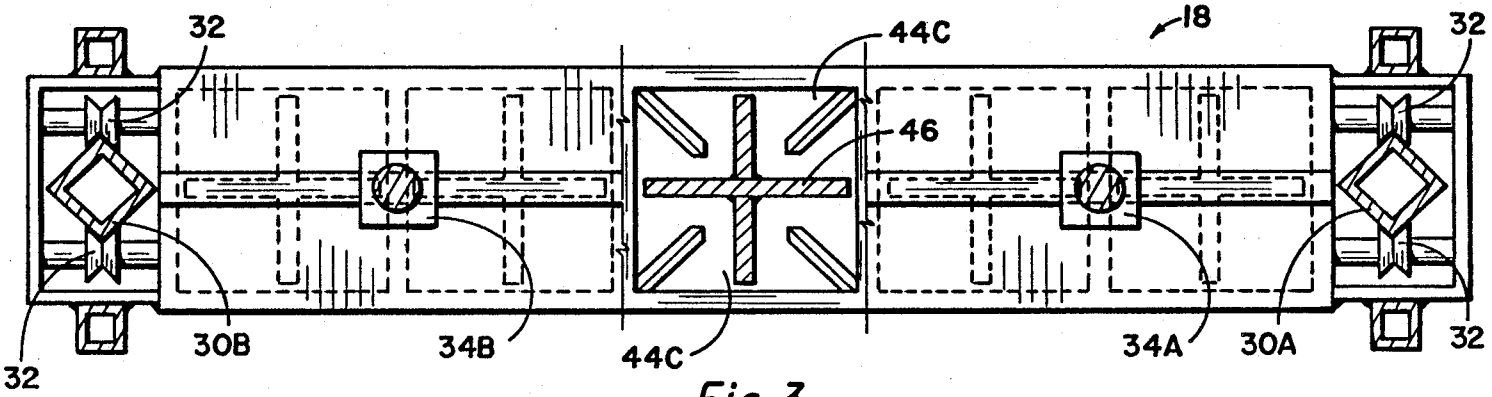
FIG. 3 is a horizontal cross-sectional view taken along the line 3—3 of FIG. 2, the cross-sectional line of FIG. 3 being broken so as to disclose the cross-sectional configuration of one embodiment of the cutters as employed in the machine.

FIG. 2 illustrates cutter plate assemblies 44A–44E which are affixed to and extend downwardly from ram 16. FIG. 3 shows a cross-sectional arrangement of cutter plate 44C which is exemplary of the other cutter plates extending from the ram. As shown in FIG. 3, the cutter plate assembly 44C is formed of a first vertical cutter plate 46 and a cross vertical plate 48. The lower edges of the vertical plate 46 and 48 encounter a portion of a wood pallet positioned on table 16 and as the ram 18 moves downwardly, the plates crush the wood pallet.

The lower edges of the cutter plate assemblies of FIG. 2 are indicated by the numerals 50A–50E. It can be observed in FIG. 2 that in a preferred embodiment the lower edges are not in a uniform plane, but instead with lower edge 50C are closer to table 16 than lower edges 50A and 50E which are furtherest from the table 16. This arrangement means that as the ram is moved downwardly the cutters engage a portion of a wood pallet positioned on the table sequentially rather than simultaneously to thereby reduce the amount of force required at any given instance to break up the wood pallet.

As seen in FIG. 1, a stop plate 52 is secured to the stationary table 16. The stop plate 52 serves to limit the movement of wood pallets 22 by conveyor 20 so that the conveyor moves the pallets to extend a portion thereof over the table 16.

Figure 6:
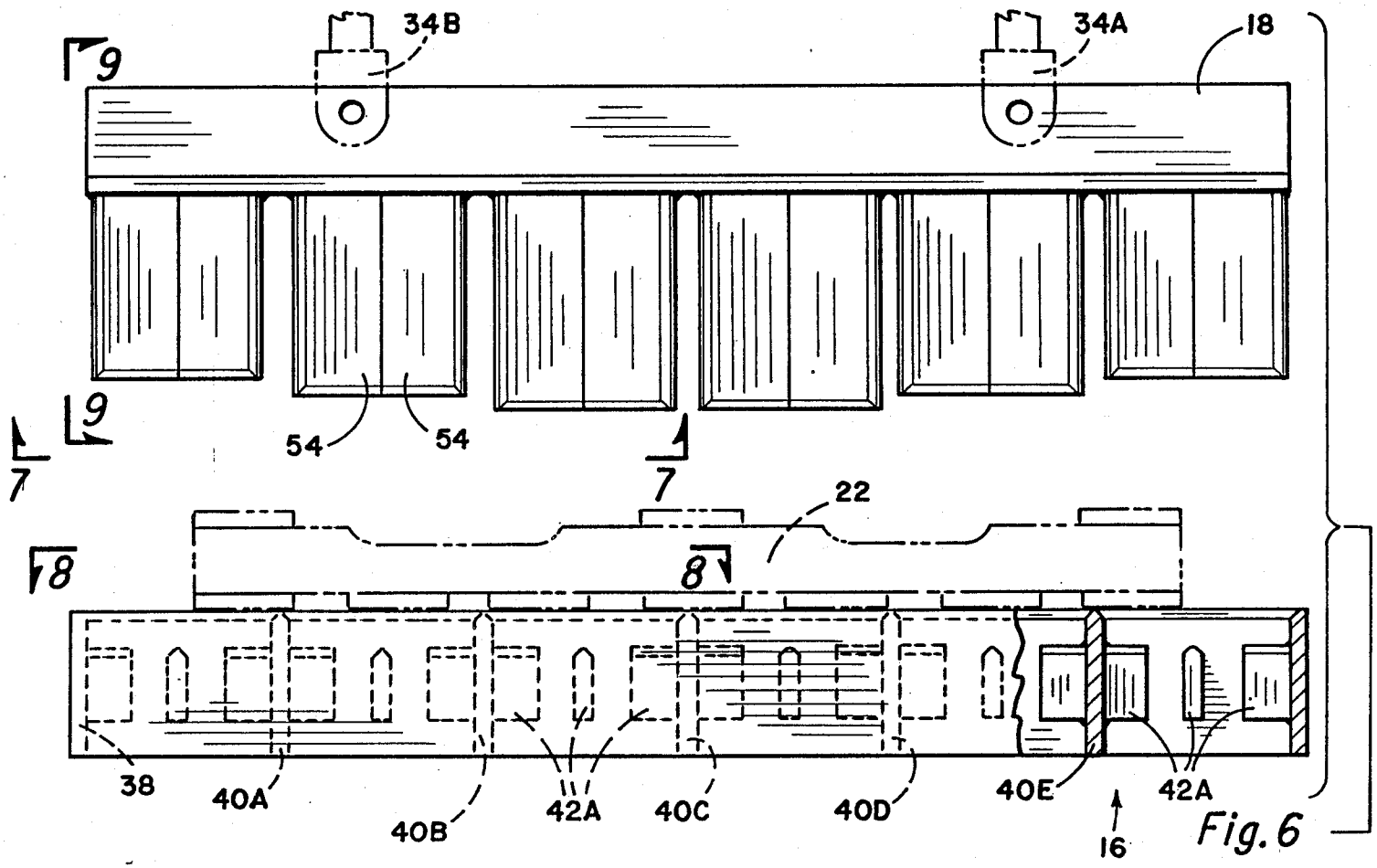
FIG. 6 is a partial view of an alternate embodiment of the invention, enlarged, showing an elevational view of the ram, and an elevational view partially in cross-section of the corresponding table with its grid system, and showing in dotted outline a portion of a typical wood pallet positioned on the table.
Figure 7:
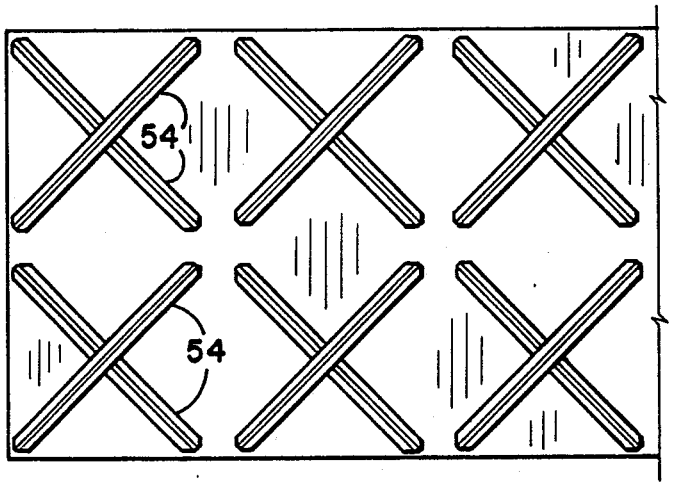
FIG. 7 is a partial horizontal view looking upwardly towards the bottom of the array of cutters forming a part of the ram of FIG. 6.
Figure 9:
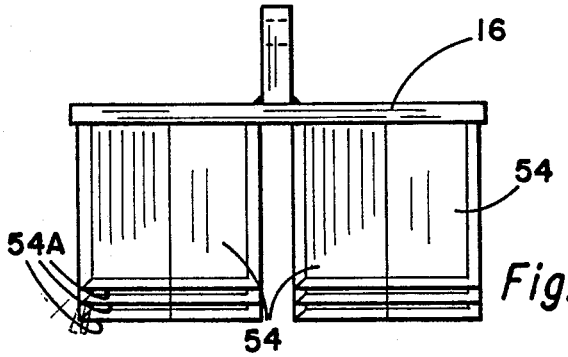
FIG. 9 is an end view of the ram of FIG. 6.

FIG. 6 shows a combined view of a table 16 and ram 18 with a different pattern of cutters secured to the ram. The pattern in FIG. 6 is illustrated in FIG. 7 wherein the vertical plates 54 forming the cutters are arranged in "X" configurations, and wherein the cutters are in an array of two parallel rows. FIG. 8 shows a configuration of the grid of the table 16 to accommodate the cutter array pattern of FIG. 7. Note that the use of lengthwise plates 36A and 36B are employed, as previously described, with a second lengthwise plate 36C and with the end plates 38 and divider plates 48, 48A, 48B and 48C employed as previously described. The difference in FIG. 8 compared with FIG. 4 is that a parallelled grid pattern is provided. In addition, the secondary plates 42A are arranged in different positions than FIG. 8 to accommodate the different grid pattern of the cutters 54 of FIG. 7. FIG. 9 shows an end view of the cutter plate 54, showing that the lower edges 54A are not of uniform elevational position to reduce the force necessary to crush a wood pallet, as previously described.

Figure 10:
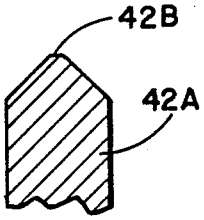
FIG. 10 is a cross-sectional view of the upper portion of a plate making up a portion of the grid system of FIG. 8.

FIG. 10 illustrates a partial elevational view of secondary cutter plate 42A, showing that the upper edge 42B is tapered to reduce the force necessary to break up wood pallets.

Figure 12:
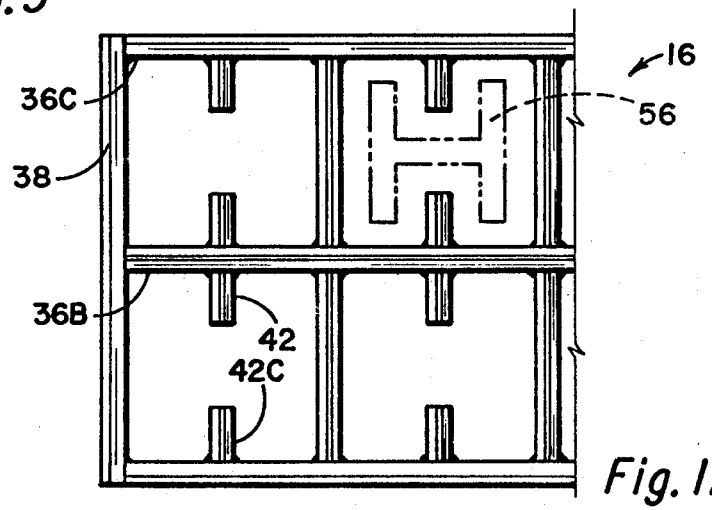
FIG. 12 is a partial horizontal view looking downwardly on a table grid system which complements the ram cutters of FIG. 11.
Figure 11:
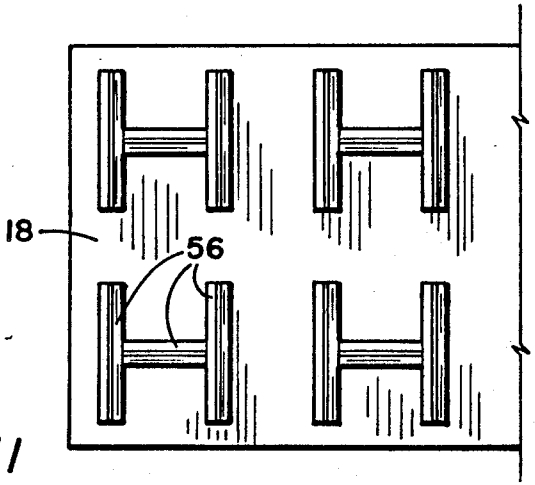
FIG. 11 is a partial horizontal view looking upwardly towards the bottom ends of the cutters of a ram, showing an alternate embodiment for the configuration of the cutters.

The arrangements of FIGS. 6, 7, 8 and 9 work in the same way as has been previously described with reference to FIGS. 1–5, the only difference being that FIGS. 6–9 illustrate a different pattern for the cutters and the grid of the stationary table. A still different pattern system is illustrated in FIGS. 11 and 12. FIG. 11 shows the vertical plates 56 of the cutters arranged in an H-shaped pattern, and FIG. 12 shows the grid pattern of the table with the same basic cross-sectional configuration as in FIG. 8, but with the secondary plates 42C arranged differently patterned to accommodate the "H" shaped pattern of the ram cutters. Thus, three separate and different patterns of cutters and stationary table grid systems are provided exemplifying different ways in which the invention may be practiced.

The claims and specification describe the invention presented, and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A machine for crushing wood pallets comprising:

a stationary table having a grid providing vertical passages therethrough;

a ram mounted above said table and reciprocable towards and away from said table and having an array of downwardly extending cutters which, when the ram is fully advanced towards said table, extend at least partially through said table grid;

means of reciprocating said ram alternately towards and away from said table;

conveyor means for moving wood pallets onto said table; and means below said table for collecting broken pieces of crushed wood pallets passing through said table grid.

2. A machine for crushing wood pallets according to claim 1 wherein said table is horizontal and said ram is reciprocated vertically above said table.

3. A machine for crushing wood pallets according to claim 1 including:

a stop plate secured to said table adjacent the side thereof opposite said conveyor means, said stop plate serving to limit the movement of wood pallets by said conveyor means and to retain at least portions of wood pallets on said grid.

4. A machine for crushing wood pallets according to claim 1 wherein said means below said table for collecting pieces of crushed wood pallets passing through said table grid includes:

hopper means and conveyor means, the pieces passing first into said hopper means and thence onto said conveyor means for disposal.

5. A machine for crushing wood pallets according to claim 1 wherein said table grid has a plurality of openings therethrough each of substantially identical cross-sectional shapes and wherein said array of downwardly extending cutters have cross-sectional shapes complementary to said grid opening shapes.

6. A machine for crushing wood pallets according to claim 1 wherein said table grid is generally rectangular in horizontal cross-section and is formed of parallelled vertical plates forming rectangular sides of said grid and a plurality of spaced apart vertical divider plates forming a plurality of generally rectangular grid openings through the table, and wherein said ram cutters are in the form of a plurality of spaced apart vertical cutter blades, the spacing being such as to register the cutter blades with said table grid openings.

7. A machine for crushing wood pallets according to claim 1 wherein said table grid has pattern-forming vertical plates within each of said generally rectangular grid openings and wherein said ram cutters are each configured in horizontal cross-section by vertical plates providing a complementary mating pattern of vertical plates which on each downward reciprocation of said ram pass between said table grid plate patterns.

8. A machine for crushing wood pallets according to claim 1 wherein each of said ram downwardly extending cutters has a lower cutting edge, and wherein the spacing of said cutter edges above said table grid varies whereby the cutters do not all strike a wood pallet positioned on said table.

* * * * *